US005907981A

United States Patent [19]

Bell

[11] Patent Number: 5,907,981

[45] **Date of Patent: *Jun. 1, 1999**

[54] CRANK APPARATUS FOR A CRANKSHAFT OF AN INTERNAL COMBUSTION ENGINE

[76] Inventor: John Bell, 20 Cottonwood, Babbitt, Minn. 55706

[ * ] Notice: This patent is subject to a terminal disclaimer.

[21] Appl. No.: 08/941,773

[22] Filed: Sep. 30, 1997

Related U.S. Application Data

[63] Continuation-in-part of application No. 08/834,132, Apr. 14, 1997, abandoned.

[51] Int. Cl.[6] ..... F16C 11/02; F16C 9/04

[52] U.S. Cl. ..... 74/598; 74/595; 123/197.4

[58] Field of Search ..... 74/595–598, 579 R, 74/579 E; 123/197.3, 197.4

[56] References Cited

U.S. PATENT DOCUMENTS

| | | | |
|---|---|---|---|
| 3,112,657 | 12/1963 | Huck | 74/590 |
| 3,208,291 | 9/1965 | Ross | 74/41 |
| 4,052,898 | 10/1977 | Miller et al. | 74/590 X |
| 4,440,123 | 4/1984 | Tsai | 74/603 X |
| 4,480,607 | 11/1984 | Tsai et al. | 74/603 |
| 4,567,864 | 2/1986 | Gaspardo | 74/579 E X |
| 4,622,864 | 11/1986 | Fetouh | 74/597 |
| 4,794,887 | 1/1989 | Valentine | 123/56 AC |
| 4,934,211 | 6/1990 | Ma | 74/595 |
| 5,186,127 | 2/1993 | Cuatico | 123/197.4 X |
| 5,555,777 | 9/1996 | Bell | 74/595 |

*Primary Examiner*—Vinh T. Luong
*Attorney, Agent, or Firm*—Harrison & Egbert

[57] ABSTRACT

An improved crank apparatus for an internal combustion engine having a crankshaft, an arm extending outwardly of the crankshaft, a crank pin affixed to the arm, a sleeve member having an elongated slot formed therein so as to receive the crank pin therein, and a piston rod with a circular bearing area receiving the sleeve member therein. The crank pin has a generally rectangular configuration with first and second tabs extending outwardly from opposite sides of the crank pin. The first tab has an outer surface with a length greater than a thickness of the crank pin. The crank pin is slidable in the elongated slot during the rotation of the crankshaft. The circular bearing area has an insert key positioned therein. the insert key bears on a surface of the sleeve member during the rotation of the crankshaft. The insert key contacts the outer surface of the first tab during at least a portion of the rotation of the crankshaft so as to cause the crank pin to slide longitudinally through the elongated slot.

19 Claims, 4 Drawing Sheets

FIG. 2
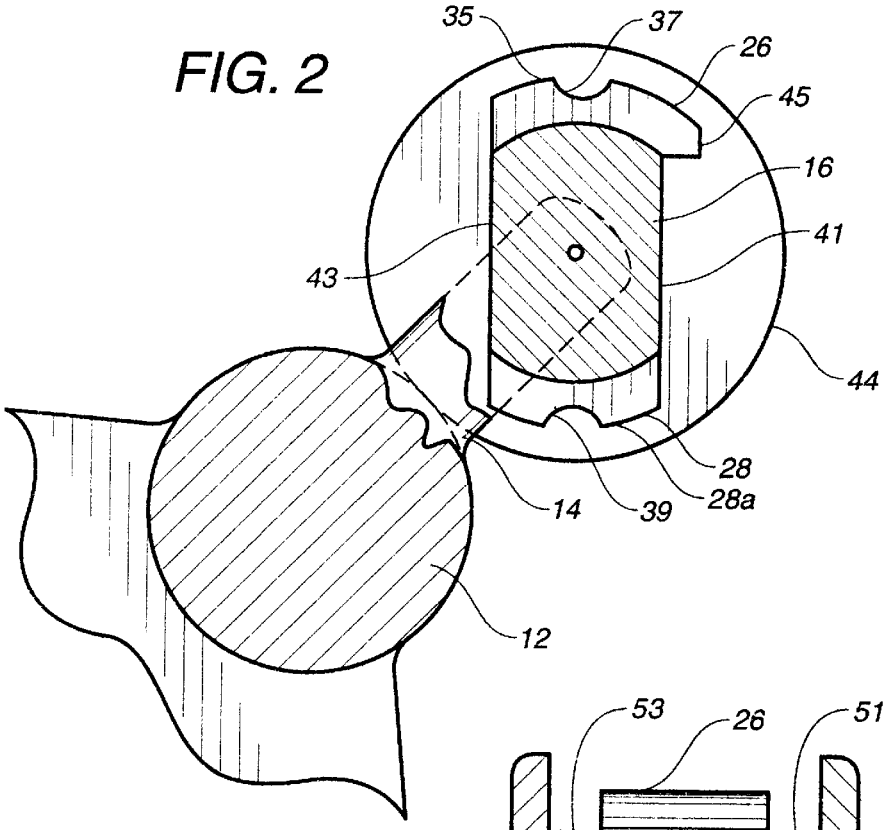
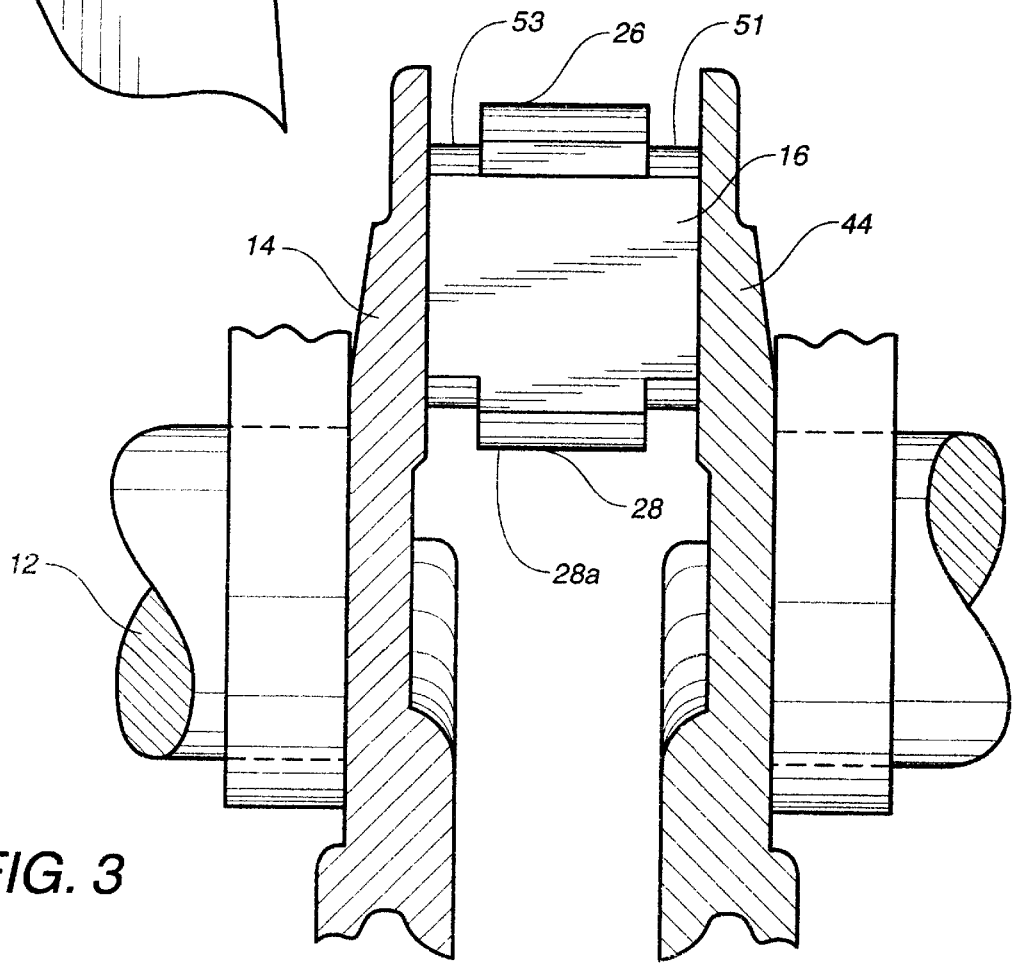
FIG. 3

CRANK APPARATUS FOR A CRANKSHAFT OF AN INTERNAL COMBUSTION ENGINE

RELATED APPLICATIONS

The present application is a continuation-in-part of U.S. patent application Ser. No. 08/834,132, filed on Apr. 14, 1997, and entitled "CRANK APPARATUS FOR A CRANKSHAFT OF A DIESEL ENGINE", now abandoned.

TECHNICAL FIELD

The present invention relates to internal combustion engines generally. More particularly, the present invention relates to the operation of the piston of the engine relative to a rotation of the crankshaft of the engine.

BACKGROUND ART

Presently, diesel engines include a piston and cylinder arrangement in which the piston rod is connected to a crankshaft and supports the piston within a cylinder. The rotation of the crankshaft causes the piston rod to move upwardly and downwardly and, as a result, causes the piston to move upwardly and downwardly within the cylinder. Presently, the beginning torque of the crank is zero ft./lbs. at the top dead center to about 10° past this point. The knocking noise of an idling diesel engine is due to the beginning explosive force that continues to about 30° or more, past the top dead center torque. As a result, the early torque generated by the diesel engine is less than optimal. Because of the faulty early torque of such a diesel engine is the inadequate geometrical relationship between the piston rod and the crankshaft.

U.S. Pat. No. 5,555,777, which issued to the present inventor on a related apparatus, describes a crank apparatus for the crankshaft of a diesel engine. In this crank apparatus, the device included a crank pin having a first tab extending outwardly from one side of the crank pin and a second tab extending outwardly from an opposite side of the crank pin. A split sleeve was provided that had an elongated slot therein. The slot receives the crank pin therein such that one of the tabs extended through an opening from the slot of the split sleeve. The piston rod was bearingly interconnected to the split sleeve. The bearing connection has an insert key connected thereto and residing within the split sleeve in a position so as to contact the crank pin upon a rotation of the crankshaft. The insert key was positioned so as to have a portion residing within the interior area between the first and second portions of the split sleeve. As such, during a rotation of the crankshaft, the tabs of the split sleeve would contact the insert key so as to cause the crank pin to slide back and forth within the elongated slot. After experimentation, it was found that this configuration did not provide enough surface contact area between the insert key and the tabs. As such, there was some "slapping" contact between the crank pin and the bearing surface during the rotation of the crankshaft. The present invention is an improvement on the teachings of the present inventor's U.S. Pat. No. 5,555,777.

U.S. application Ser. No. 08/834,132, filed on Apr. 14, 1997, by the present inventor also describes an improved crank apparatus for a diesel engine. This crank apparatus includes a crankshaft, an arm extending outwardly of the crankshaft, a crank pin affixed to the arm and having a generally rectangular configuration, a sleeve member having an elongated rectangular slot formed therein, and a piston rod having a circular bearing area receiving the sleeve member therein. The crank pin is slidable in the rectangular slot relative to a rotation of the crankshaft. The sleeve member has a smaller diameter than the circular bearing area. The circular bearing area has an insert key positioned therein. This insert key bears on a surface of the sleeve member during the rotation of the crankshaft. The sleeve member is a split sleeve having a first portion and a second portion affixed together around the crank pin. The sleeve member is split diagonally thereacross. The tapered sides of these sleeve members are affixed together in surface-to-surface contact through the use of doweled members. The piston rod has split caps extending around the sleeve member. The split caps define the circular bearing area. The insert key is affixed in one of the split caps. Specifically, the insert key is inserted within an interior cavity of one of the split caps. The insert key is positioned so as to have an edge extending into the circular bearing area. The sleeve member contacts the insert key at a point offset by approximately 70° from a centerline of the piston rod when the piston is in its furthest point from the crankshaft. In particular, the sleeve member will bear on a surface of the circular bearing area during the rotation of the crankshaft. During the rotation of the crank, the sleeve member will shift over the crank pin. On the "downstroke", it will shift to one side. On the "upstroke", the sleeve will shift to the opposite side. In this turning process, the round outer diameter of the sleeve actually rolls and slides in constant contact with the rod's bearing surface without any slapping during the crank pin and rod angle shifting in one revolution. The particular arrangement of the present invention provides a "top dead off center" at about a seven degree offset position advance at the high position of the piston so as to eliminate most of the beginning stress in such internal combustion engine.

It is an object of the present invention to provide an improved crank apparatus to improve the efficiency of the crank mechanism of an internal combustion engine.

It is another object of the present invention to provide a crank apparatus for an engine that enhances the torque at the top dead center of the crank.

It is a further object of the present invention to provide an improved crank apparatus that improves fuel economy, increases power, and eliminates the knocking noise of the diesel engine.

These and other objects and advantages of the present invention will become apparent from a reading of the attached specification and appended claims.

SUMMARY OF THE INVENTION

The present invention is an improved crank apparatus for an engine that comprises a crankshaft, an arm extending outwardly of the crankshaft, a crank pin affixed to the arm and having a generally rectangular configuration with a first tab and a second tab extending outwardly from opposite sides thereof, a sleeve member having an elongated slot formed therein for receiving the crank pin therein, and a piston rod with a circular bearing area for receiving the sleeve member therein. The crank pin is slidable in the slot relative to a rotation of the crankshaft. In particular, the first tab of the crank pin has an outer surface with a length greater than a thickness of the crank pin. The circular bearing area includes an insert key positioned therein. The insert key contacts the outer surface of the first tab during a portion of the rotation of the crankshaft.

The sleeve member is a split sleeve having a first portion extending around the crank pin on one side of the first and second tabs and a second portion extending around the crank pin on an opposite side of the first and second tabs. The insert key is positioned between the first and second portions of the sleeve member. The insert key contacts an outer surface of the second tab during another portion of the rotation of the crankshaft. The crank pin slides in the elongated slot relative to a contact between the insert key and a surface of first and second tabs.

The outer surface of the first tab has a curved surface that will extend over a portion of the side of the crank pin extending between the first and second tabs. An undercut is formed on the first tab so as to extend inwardly of the outer surface of the first tab. The second tab also has an undercut formed therein so as to extend inwardly of the outer surface of the second tab. The undercut of the second tab is positioned 180° from the undercut of the first tab.

BRIEF DESCRIPTION OF THE DRAWINGS

FIG. 2 is an isolated side elevational view of the crankshaft and crank pin of the present invention.

FIG. 3 is an end view of the crankshaft and crank pin of the present invention.

DETAILED DESCRIPTION OF THE INVENTION

Figure 1:
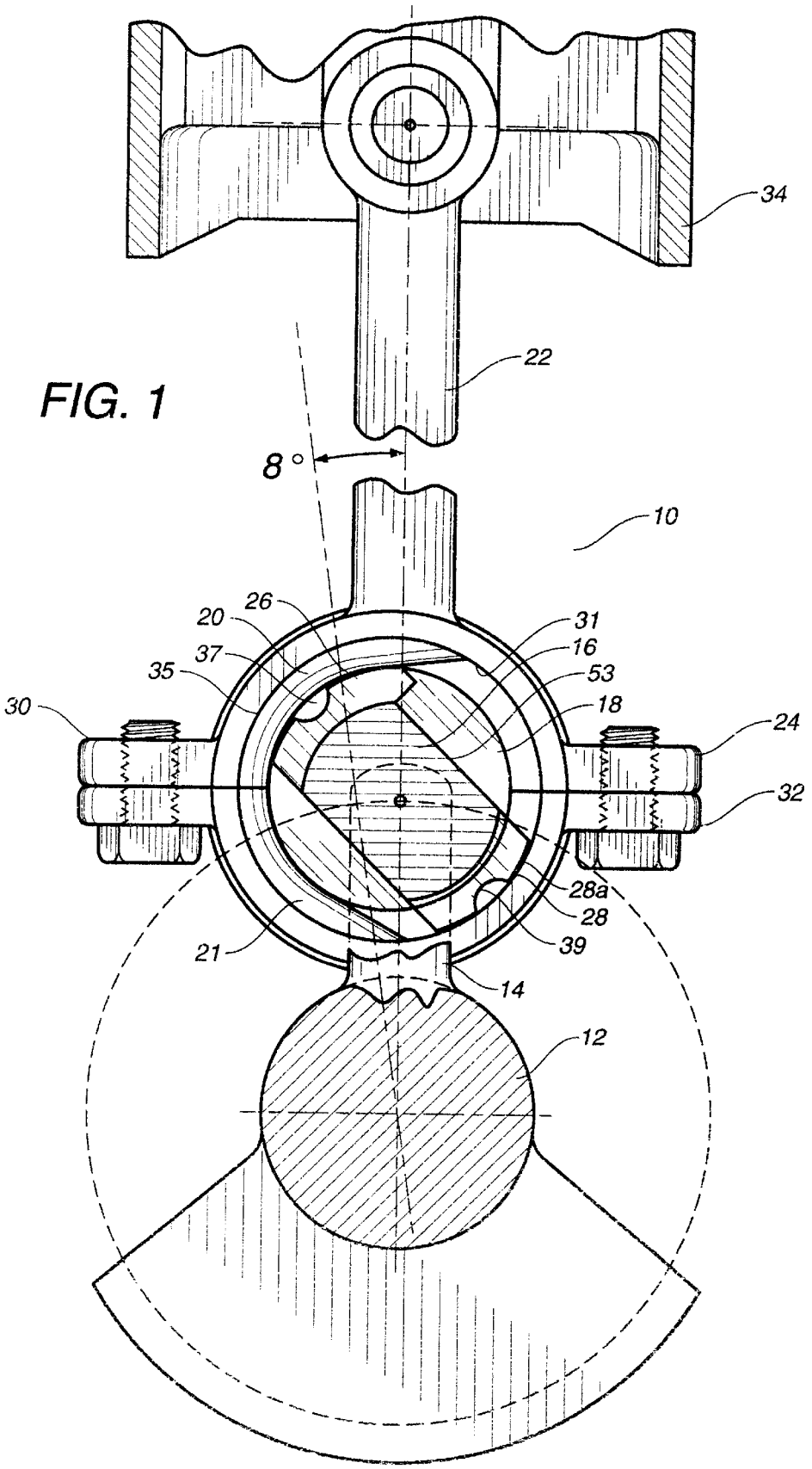
FIG. 1 is a side elevational view of the crank apparatus of the present invention.

Referring to FIG. 1, there is shown at 10 the improved crank apparatus in accordance with the preferred embodiment of the present invention. The improved crank apparatus includes a crankshaft 12, an arm 14, a crank pin 16, a sleeve member 18, an insert key 20, a piston rod 22, split caps 24, and piston 34.

As can be seen in FIG. 1, the crankshaft 12 is in the form of a standard crankshaft used on a diesel engine. The arm 14 (illustrated in greater particularity in FIG. 2 and in FIG. 3) extends outwardly from the crankshaft 12 so as to rotate with the rotation of the crankshaft 12. The crank pin 16 is affixed to the arm 14. The crank pin 16 has a generally rectangular configuration and cross-section. Crank pin 16 has a first tab 26 and a second tab 28 extending outwardly from opposite sides thereof. The crank pin 16 is received within a rectangular slot 53 formed within the sleeve member 18. The insert key 20 is received within the first split cap 30, and extended into the bottom lower cap to about 45° span. This span extension will keep opposite tab ends locked within the rod bearing and the insert key to prevent any "slap". The first split cap 30 serves to secure the insert key 20 within the circular bearing area 31. The first split cap 30 is secured to the second split cap 32 so as to be affixed together to define the circular bearing area 31. It can be seen that the sleeve member 18 is retained within this circular bearing area 31. The circular bearing area 31 will have a greater diameter than the diameter of the sleeve member 18, which is a clearance slot for the insert key.

The piston rod 22 extends outwardly from the first split cap 30. The piston rod 22 is connected to a piston 34 at an end opposite the circular bearing area 31 and the crankshaft 12. The rotation of the crankshaft 12 will cause the piston rod 22 to move eccentrically upwardly and downwardly so as to cause a movement of the piston 34 within the cylinder of a diesel engine. It is the special configuration of the sleeve member 18 with the crank pin 16 that allows the crank apparatus 10 of the present invention to achieve maximum efficiency in the operation of the diesel engine.

As can be seen in FIG. 1, the first tab 26 has an outer surface 35 which is curved and which has a length greater than the adjacent side of the crank pin 16. Similarly, the second tab 28 will have a curved outer surface 28*a*. An undercut 37 is formed in the first tab 26 so as to extend inwardly from the outer surface 35. The second tab 28 has an undercut 39 which will extend inwardly from the curved outer surface of the second tab 28. The tabs 26 and 28 have a special configuration that facilitates the operation of the present invention. In particular, each of the first tab 26 and the second tab 28 will contact the insert keys 20 and 21. This spans the lower rod bearing cap during different portions of the rotation of the crankshaft 12.

FIG. 2 is an isolated view of the crank pin 16. As can be seen, the crank pin 16 is secured to arm 14 which extends from the crankshaft 12. The crank pin 16 has a cross-section of generally rectangular configuration. Supporting structure 28 receives an end of the crank pin 16 and serves to secure the crank pin to the arm 14. Crank pin 16 has first tab 26 extending outwardly from one end of the crank pin 16. The crank pin 16 also has a second tab 28 extending from an opposite end of the crank pin. As can be seen, the tab 26 has a curved outer surface 35 with an undercut 37 formed therein. The curved outer surface 35 has a length which is greater than the thickness of the crank pin 16 as measured between sides 41 and 43 of crank pin 16. It can be seen that an end 45 of the tab 26 will extend slightly over a portion of the side 41. The undercut 37 extends inwardly from the curved outer surface 35. The second tab 28 includes an undercut 39 formed therein. The second tab 28 has a curved outer surface 28*a*. As can be seen, in FIG. 2, the curved outer surface 28*a* 28 has a length which is slightly greater than the thickness of the crank pin 16 as measured between sides 41 and 43. In an alternative form of the present invention, the second tab 28 can have a configuration similar to that of first tab 26 and having a portion overlapping an edge of the side 43 of crank pin 16. The flat surfaces 41 and 43 of the crank pin 16 are offset by approximately 45° from the longitudinal axis of the arm 14. Arm 14 extends outwardly radially from the crankshaft 12.

The crank pin 16 will retain its orientation, with respect to the arm 14, during the entire rotation of the crankshaft 12.

As can be seen in FIG. 3, the crankshaft 12 has a first arm 14 affixed thereto and a second arm 44 affixed thereto in spaced parallel relationship to the first arm 14. The crank pin 16 has its rectangular cross-sectional area extending between the arms 14 and 44. As can be seen, in FIG. 3, the first tab 26 and the second tab 28 are positioned generally centrally along the width of the crank pin 16 as measured between arms 14 and 44. A slotted area 51 is provided between the tabs 26 and 28 and the arm 44. A slotted area 53 is provided between the tabs 26 and 28 and the first arm 14. Slotted areas 51 and 53 serve to receive portions of the sleeve 18.

Figure 4:
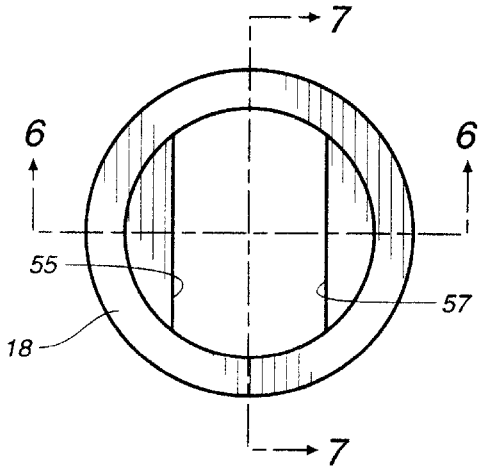
FIG. 4 is an isolated side elevational view of the sleeve member of the present invention.

FIG. 4 illustrates the sleeve member 18 of the crank apparatus 10 of the present invention. It can be seen that the sleeve member 18 has a central rectangular slot 53 formed therein. Slot 53 serves to receive the rectangular crank pin 16 therein. The sleeve member 18 has two outer circular rings that are of the same diameters as the rod's bearing that locks in the sleeve/rod as one unit, as can be seen in FIG. 4. The rectangular slot 53 has a side 55 which will be in sliding surface-to-surface contact with the side 43 of the crank pin 16. A side 57 is provided on the rectangular slot 53 so as to be in sliding surface-to-surface contact with the side 41 of the crank pin. The sleeve 18 can be split in many manners so as to facilitate the installation of the crank pin 16 into the rectangular slot 53. One technique of forming the split sleeve was described in prior application Ser. No. 08/834,132. In general, the central rectangular slot 53 has a length which is greater than a length of the crank pin 16 (or the distance between the outer surfaces of tabs 26 and 28). The rectangular slot 53 will have a width that generally matches the width of the crank pin 16. As such, the crank pin 16 will be received slidably within the interior of the rectangular slot 53.

Figure 5:
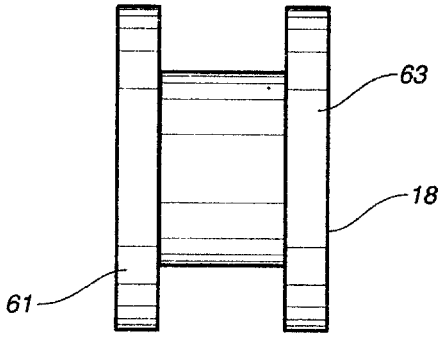
FIG. 5 is a end view of the sleeve member of the present invention.

FIG. 5 shows the end view of the sleeve member 18. It can be seen that the sleeve member 18 has a first outer diameter ring 61 and a second portion 63. The central area 65 resides between the first portion 61 outer ring diameter and a second portion 63. In normal use, the slotted area 51 will receive the second portion ring 63 of the sleeve 18. Similarly, the slotted area 53 will receive the first portion 61 of the sleeve 18. The tabs 26 and 28 will extend through openings formed on the interior of the sleeve 18. In normal operation, the insert key will bear against the outer surface of the central area 65 of sleeve 18.

Figure 6:
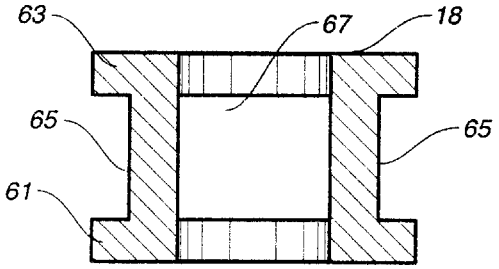
FIG. 6 is a cross-sectional view of the sleeve member of the present invention as taken across lines 6—6 of FIG. 4.

FIG. 6 shows the interior of the sleeve 18. In particular, it can be seen that the first portion 63 is spaced from the first portion 61 such that central area 65 resides therebetween. Opening 67 is formed so as to allow the tabs 26 and 28 to extend outwardly therethrough during the rotation of the sleeve 18.

Figure 7:
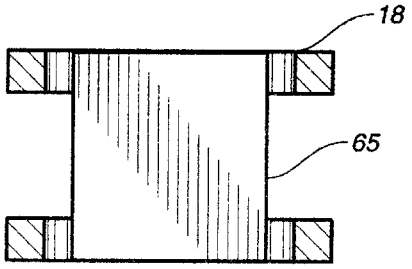
FIG. 7 is a cross-sectional view of the sleeve member of the present invention as taken across lines 7—7 of FIG. 4.

FIG. 7 shows a cross-sectional view of the sleeve 18 as taken from the transverse axis relative to FIG. 6.

Figure 8:
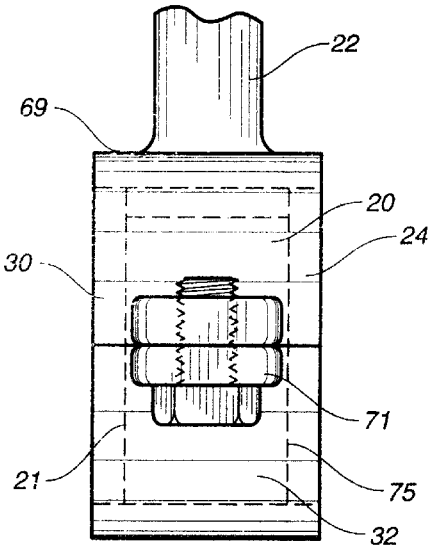
FIG. 8 is an end view of the crank apparatus of the present invention.

FIG. 8 shows a side view of the split caps 24. As can be seen, the insert key 20 will reside within the interior of the first split cap 30. The piston rod 22 extends upwardly from the top 69 of the first split cap 30. Bolting member 71 serves to secure the first split cap 30 with the second split cap 32.

Figure 9:
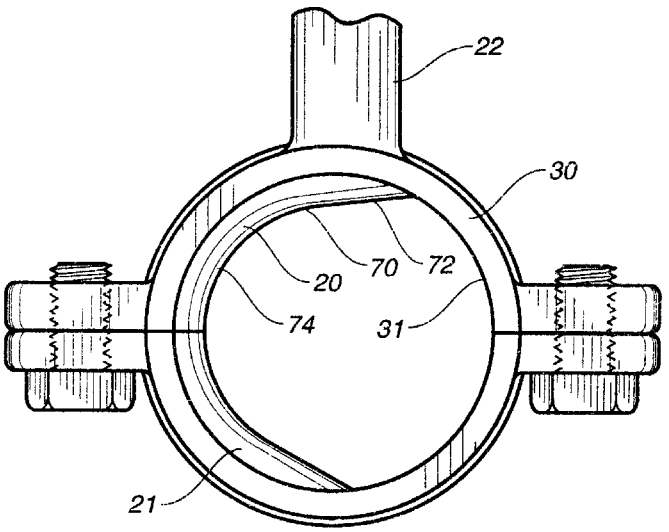
FIG. 9 is an isolated side elevational view showing the relationship of the insert key with the piston rod of the present invention.

FIG. 9 shows an isolated view of the insert key 20 as secured within the first split cap 30 and positioned within the interior area of the circular bearing area 31. Piston rod 22 extends vertically upwardly from a top surface of the split cap 30. The split cap 30 is bolted to the second split cap 32 so as to form the circular bearing area 31 for the receipt of the sleeve member 18. In this arrangement, the piston rod 22 will move with the movement of the sleeve member 18.

As can be seen in FIG. 9, the insert key 20 is received within an interior cavity on the first split cap 30, and down to 45° below into cap 32. The insert key 20 has an edge 70 which extends into the circular bearing area 31. Edge 70 includes a tapered end 72 which extends outwardly from the generally curved edge 74. The edge 70 of the insert key 20 will bear on the surface of the central area 65 of the sleeve member 18 during the rotation of the crankshaft. The piston rod 22 has a longitudinal axis which is offset by approximately 75° from the edge 70 of the insert key 20. It has been found that this geometry between the piston rod 22 and the insert key 20 further improves the piston's leverage lift efficiency and the effectiveness of the crank apparatus 10 of the present invention.

The insert key 20 is received within the interior cavity 75 in a desired manner. Within the concept of the present invention, it is possible for the insert key 20 to be formed within the first split cap 30 and 32 as a unitary construction. In fact, for actual production, it is probably necessary that the split caps 30 and 32 and the keys 20 and 21 be integrally formed together.

Figure 10:
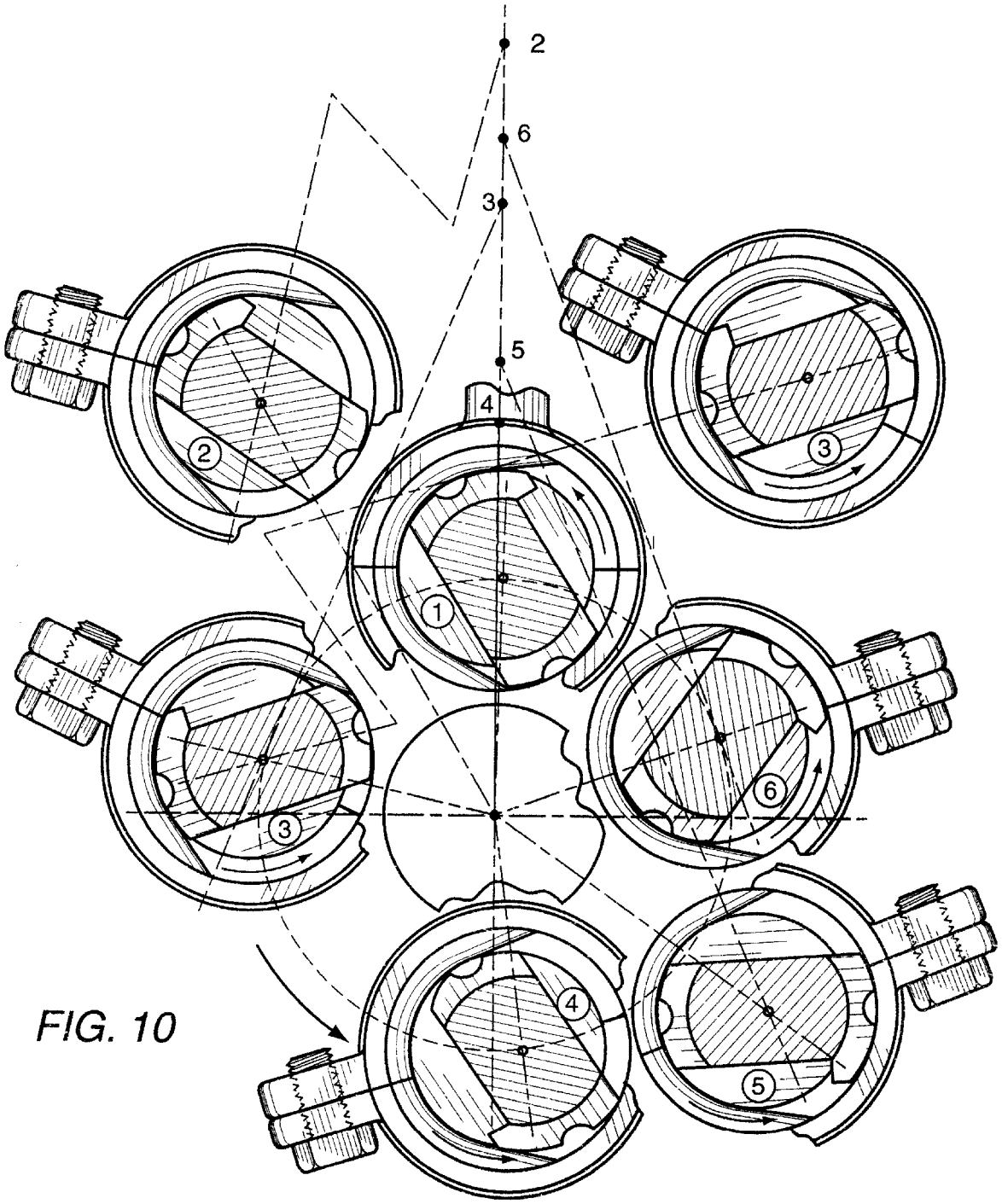
FIG. 10 is an operational view of the crank apparatus of the present invention showing the movement of the crank apparatus during the rotation of the crankshaft.

FIG. 10 illustrates the operation of the crank apparatus of the present invention. In order to improve on the conventional faulty crank apparatus of a diesel engine, the present invention modifies the crank pin's bearing area from a round configuration to a square or rectangular crank pin 16. The crank pin 16 is enclosed within the rectangular slot 26 of the sleeve member 18.

What makes the crank apparatus of the present invention superior to the traditional crank is that it changes the beginning torque behavior. In particular, the crank will have 6 to 8 degrees torque gain at top dead "off" center position. This reduces the conventional engine's "knocking" explosion that is inherent in running at low idling speeds. The configuration of the crank apparatus of the present invention further reduces fuel consumption.

Relative to FIG. 10, it can be seen that the various angular positions of the sleeve/rod shifting over the rectangular crank pin are illustrated during the four-cycle movements of any four-cycle engine. As can be seen in the illustrations identified with numeric references "1" through "4", the power stroke is illustrated. As can be seen from these illustrations, the sleeve/rod slides outward over the crank pin to the end of the power stroke. The crank pin is locked between the cam (the high point) and the bottom of the rod's bearing surface. This is the up-stroke piston stop height position. The second stage of the four-cycle engine, the exhaust cycle, is illustrated by numeric reference "5" in the attached drawings. As can be seen in the illustration identified as "5", the rod/sleeve is positioned such that the crank's stored energy is doing the work on the sleeve/rod. At this stage, the sleeve/rod does not move over the crank pin. The unit remains inward (a short radius on the upstroke). At the stage of the four-cycle engine, identified with the numeric reference "3", the piston is now past the piston center line so as to move to a new top dead off center, the top height stop position of the piston. This is identified as the fuel/air intake cycle stage. This is carried out with the crank's stored energy power. In this "downstroke" cycle, the sleeve/rod unit slides over the crank outwardly (sleeve/rod radius changes). However, the stage "3" only shows the power stroke cycle. The last (upstroke) stage cycle, the fuel/air compression cycle, is illustrated with numeric reference "4". In this stage, the crank is doing the stored power work on the sleeve/rod/piston's compression. The cam is controlling the sleeve/rod movement so as to shift it outwardly (a bigger radius), until it reaches the position of stage "5". At this stage, the cam stops any slapping between the crank pin and the rod's bearing. At position "6", it can be seen how the crank pin is lifting the sleeve/rod/piston unit to the top dead off center position.

The present invention includes the "tabs" which are wider with extended large contact radii for controlling the sleeve/rod/assembly movements. In particular, it can be seen that on tab 26, there is an outer right hand extended radius to one end of the crank pin for greater contact area with the cam's and rod's bearing surface.

The crank pin's length is very critical for smooth crank movement. The length must be as near equal to the rod's diameter, minus the cam's depth (approximately ¼ of an inch). This will give the sleeve/rod/piston assembly a smooth operation with the "fixed" radius crank pin. The ratio between the rod's bearing diameter to the crank pin's length has thus been found to be a very important feature of the present invention so as to prevent any slapping.

The present invention provides two clearance undercuts 51 and 53 adjacent to the throw arms 14 and 44 of the crank pin 16. As a result, the ends of the sleeve (the outer flat surfaces 61 and 63) will have clearance room for the sleeve/rod unit to slide "up and down" over the crank pin. In the two outer diameter ends of the sleeve, there are two narrow bands that lock and turn in the rod's bearing. The purpose of these bands is to keep the rod and sleeve together as a unit. The leverage action of the cam of shifting and lifting the piston assembly by the flat crank pin produces a new torque gain position at the beginning of the power stroke. The concept of the present invention can be applied to any exploding fuel-type powered internal combustion engine, even with gasoline fuel engines, so as to control the beginning explosion stress. The diesel engine needs controlled fuel injection at all speeds to keep it from knocking. The flat crank pin concept of the present invention will greatly help control some of these defects.

Through the use of the present invention, in a four-cycle engine, three of the cycles are driven by the kinetic energy of the crank.

Within the concept of the present invention, it is possible to add an extended radius surface to the tab 28 in the manner of tab 26.

The use of the undercuts on the surfaces of the tabs 26 and 28 provides a better radius span and the best pressure area on the cam's high point. The undercut is carried out for sleeve clearance in order for it to move about ¼ of an inch over the crank pin. The undercut can also serve to allow for the introduction of lubrication into the area between the crank pin and the bearing surface.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. An crank apparatus for an engine comprising:

a crankshaft;

an arm extending outwardly of the crankshaft;

a crank pin affixed to said arm, said crank pin having a rectangular configuration, said crank pin having a first tab extending outwardly from one side of said crank pin and a second tab extending outwardly from an opposite side of said crank pin, said first tab having an outer surface with a length greater than a thickness of said crank pin;

a sleeve member having an elongated slot formed therein, said slot receiving said crank pin therein, said crank pin slidable in said slot relative to a rotation of said crankshaft; and a piston rod having a circular bearing area, said sleeve member having a smaller diameter than said circular bearing area, said bearing area receiving said sleeve member therein, said circular bearing area having an insert key positioned therein, said insert key bearing on a surface of said sleeve member during the rotation of said crankshaft, said insert key contacting said outer surface of said first tab during a portion of the rotation of said crankshaft.

2. The apparatus of claim 1, said arm comprising:

a first arm affixed to the crankshaft; and a second arm affixed to the crankshaft in spaced parallel relationship to the first arm, the crank pin extending between the first and second arms.

3. The apparatus of claim 2, said first and second arms having an axis extending radially outwardly from the crankshaft, said crank pin having a flat surface offset by 45° or less from said axis of said arms.

4. The apparatus of claim 1, said sleeve member being a split sleeve having a first portion extending around said crank pin on one side of said first and second tabs, said split sleeve having a second portion extending around said crank pin on an opposite side of said first and second tabs.

5. The apparatus of claim 4, said insert key being positioned between said first and second portions of said sleeve member.

6. The apparatus of claim 5, said insert key contacting an outer surface of said second tab during another portion of the rotation of said crankshaft.

7. The apparatus of claim 1, said piston rod having split caps extending around said sleeve member, said split caps defining said circular bearing area, said insert key being affixed in one of said split caps.

8. The apparatus of claim 4, said insert key having an edge bearing against the surface of said sleeve member between said first and second portions, said edge having a tapered portion extending further into said circular bearing area than a remainder of said insert key.

9. The apparatus of claim 1, said piston rod comprising:

a first split cap and a second split cap secured together around said sleeve member, said piston rod extending outwardly from said first split caps, said piston rod having a longitudinal axis extending therethrough, said insert key having a longitudinal axis offset by approximately 75° from said longitudinal axis of said piston rod.

10. The apparatus of claim 1, said outer surface of said first tab being a curved surface, said curved surface extending over a portion of a side of said crank pin extending between said first and second tabs.

11. The apparatus of claim 1, said outer surface of said first tab having a first undercut formed therein so as to extend inwardly of said outer surface of said first tab.

12. The apparatus of claim 11, said first undercut positioned along said length of said outer surface between ends of said first tab.

13. The apparatus of claim 11, said second tab having a second undercut formed therein so as to extend inwardly of an outer surface of said second tab.

14. The apparatus of claim 13, said second undercut positioned 180° from said first undercut.

15. The apparatus of claim 1, said second tab having an outer surface, said outer surface of said second tab contacting said insert key during another portion of the rotation of said crankshaft.

16. The apparatus of claim 15, said outer surface of said second tab having a length greater than the thickness of said crank pin.

17. The apparatus of claim 1, said first and second tabs having a width less than a width of said crank pin, said first and second tabs positioned centrally along the width of said crank pin.

18. The apparatus of claim 1, said crank pin having a top surface and a bottom surface, said elongated slot having a top surface in sliding surface-to-surface contact with said top surface of said crank pin, said elongated slot having a bottom surface in sliding surface-to-surface contact with said bottom surface of said crank pin.

19. The apparatus of claim 1, further comprising:

a piston connected to an opposite end of said piston rod from said circular bearing area.

* * * * *